US007908781B2

(12) United States Patent
Laney et al.

(10) Patent No.: US 7,908,781 B2
(45) Date of Patent: Mar. 22, 2011

(54) MUZZLE LOADING FIREARM WITH BREAK-OPEN ACTION

(75) Inventors: Mark C. Laney, Lee, NH (US); Matthew Zglobicki, Acton, ME (US)

(73) Assignee: Thompson/Center Arms Company, Inc., Rochester, NH (US)

( * ) Notice: Subject to any disclaimer, the term of this patent is extended or adjusted under 35 U.S.C. 154(b) by 570 days.

(21) Appl. No.: 11/971,933

(22) Filed: Jan. 10, 2008

(65) Prior Publication Data

US 2010/0281732 A1 Nov. 11, 2010

(51) Int. Cl.
*F41C 9/08* (2006.01)

(52) U.S. Cl. ..... 42/51

(58) Field of Classification Search ..... 42/51; 89/1.3
See application file for complete search history.

(56) References Cited

U.S. PATENT DOCUMENTS

| | | | | |
|---|---|---|---|---|
| 2,354,025 | A * | 7/1944 | Johnson | 42/1.15 |
| 6,604,311 | B1 | 8/2003 | Laney et al. | |
| 7,065,913 | B2 | 6/2006 | Lizarralde et al. | |
| 7,316,092 | B2 * | 1/2008 | DeLeeuw | 42/51 |

* cited by examiner

*Primary Examiner* — Stephen M Johnson
(74) *Attorney, Agent, or Firm* — McCormick, Paulding & Huber LLP

(57) ABSTRACT

A muzzle loading firearm with a break-open action includes a rear stock assembly and a barrel assembly. The barrel assembly includes an elongate barrel, having a bore with muzzle and breech ends, and a breech plug removably connected the breech end of the barrel, which encloses a chamber at the rear of the bore. The barrel assembly is pivotally attached to the rear stock assembly, and is movable with respect to the stock assembly between an open position in which the breech end is accessible for service, and a closed position in which the breech end is inaccessible and secured for discharge. A lever arm, optionally configured to serve as the firearm trigger guard, is user actuated for moving the action between the open and closed positions. The breech plug is configured for rapid removal from the barrel by hand when the action is open.

26 Claims, 7 Drawing Sheets

MUZZLE LOADING FIREARM WITH BREAK-OPEN ACTION

FIELD OF THE INVENTION

This invention relates to muzzle loading firearms and, more particularly, to mechanisms for opening firearm actions.

BACKGROUND OF THE INVENTION

Muzzle loading rifles have an essentially closed breech at the rear of the barrel, so that powder and projectiles must be loaded at the muzzle or forward end of the barrel. A typical muzzle loading rifle has a barrel with a breech plug attached to occupy an enlarged, internally threaded, rear bore portion of the barrel at the breech end. In some rifles, the breech plug is permanently attached. In others, the breech plug is removable to facilitate pass-through cleaning of the bore or similar operations.

A conventional removable breech plug employs a finely threaded elongated body that screws into the rear of the barrel, which is internally threaded to receive the plug. Typically, ten to fifteen turns are required to secure the breech plug in place. The breech plug is not removed for normal loading operations, but rather for cleaning purposes. The cleaning process involves removing the breech plug, and then passing a brush-tipped rod through the entire length of the barrel by inserting the rod into one end of the barrel and dragging it out of the other end. The brush, wetted with a liquid cleaning agent, dissolves and dislodges fouling.

During a typical shooting session, the breech plug remains closed. For each shot, powder and a projectile are inserted into the muzzle, and a fresh primer is inserted into a pocket that is centrally located at the rear of the breech plug. When the firearm is discharged, the primer is ignited and a small-diameter passage in the breech plug transmits the flash from the primer to the powder in the barrel interior. The primer is retained in place by a breech block that swings into a locked position over the breech plug, and the primer may be removed when the breech block is moved away to an unlocked position. Such a system is shown in U.S. Pat. No. 6,604,311 entitled "Lever Operated Breechblock for Muzzle-Loading Firearm," which is incorporated herein by reference. This system utilizes a fixed barrel and stock, and a drop down-type firing mechanism and breech block assembly. The firing mechanism and breech block are pivotally attached to the barrel/stock through a linkage that is operated by a lever on the trigger guard. In a closed position, the breech block is locked over the breech plug, and the firing mechanism is located in a conventional position for firing, with the trigger lying proximate to the underside of the stock. For opening the assembly, the lever on the trigger guard is pulled downwards, causing the entire firing mechanism and breech block assembly to pivot downwards.

Although the system in U.S. Pat. No. 6,604,311 is functional, it includes a stock that is fixed to the barrel. This makes it more difficult for pass-through cleaning, since the upper portion of the stock, located to the rear of the breech, limits access to the breech. To provide unlimited access, the stock must be contoured to provide an access space, which may disadvantageously limit design options. Furthermore, the stock portion adjacent to the breech may make it more difficult or slow to insert a new primer, and to access the breech for breech plug removal. Additionally, because the major components (e.g., stock and barrel) of the rifle are fixed with respect to each other, it requires more scrutiny to determine whether the rifle is in a clearly inoperable condition. For example, when lying with the breech block moved to the open position (preventing the firing pin from striking the primer), the position of the trigger guard is not readily detected at a distance, such as might be desired at a shooting range, during instruction, or a similar situation.

A further limitation of existing designs is that the process required for cleaning is somewhat cumbersome. In the system of U.S. Pat. No. 6,604,311, for example, to clean the barrel without a risk of harming the stock with cleaning solution, the stock must be removed. This requires removal of a butt pad from the stock, and the rear stock from the rifle by removing a blind screw. This can be somewhat difficult for the user, and risks damage. Moreover, the receiver and other operational elements remain attached to the barrel, making cleaning less convenient.

SUMMARY OF THE INVENTION

To overcome the aforementioned limitations of the prior art, an embodiment of the present invention relates to a muzzle loading handheld firearm with a break-open action. The firearm includes a rear stock assembly and a barrel assembly. The barrel assembly includes a barrel, which has an elongated bore with muzzle (forward) and breech (rear) ends, and a breech plug removably connected to the breech end of the barrel that encloses a chamber at the rear of the bore. The barrel assembly is pivotally attached to the rear stock assembly, and is movable with respect to the stock assembly between an open position in which the breech end of the barrel is accessible for service, and a closed position in which the breech end is inaccessible and the firearm is secured for discharge. In operation, the barrel assembly is pivoted to the open position for outfitting the breech plug with a primer charge. (In the open position, the breech plug is also accessible for removal or other service operations.) Then, the barrel assembly is pivoted to the closed position for discharging the firearm. A breech block, fixed to the stock assembly, is provided to cover the breech plug when the barrel assembly is closed.

In another embodiment, a user-actuated lever arm is provided for moving the barrel assembly between the open and closed positions, and for securing the barrel assembly in the closed position. The lever arm is pivotally connected to a pivot link, which in turn is pivotally connected to the stock assembly. The lever arm is also pivotally connected to a lug arm portion of the barrel assembly, which is attached to an underside of the barrel. (The barrel assembly pivot axis extends through the lug arm, off axis of the barrel.) In operation, from the closed position of the barrel assembly and lever arm, movement of the lever arm causes the lug arm to pivot about the barrel assembly pivot axis. This causes the barrel assembly to pivot away from the stock assembly, exposing the breech end of the barrel for user access. The pivot link acts as a moving lever point, for maintaining the lever arm in the proper orientation for levering the lug arm and barrel assembly about the pivot axis. The pivot link, though an over-center configuration, also serves to maintain the lever arm and barrel assembly in the locked closed position until the lever arm is purposefully pivoted/actuated by a user of the firearm. In one embodiment, the lever arm is configured to additionally function as the trigger guard of the firearm.

In another embodiment, the breech plug is a configured for hand-actuated rapid release from the barrel breech end. The breech plug includes a shaft portion and a knurled actuator knob portion, which is attached to the rear end of the shaft. The fore end of the shaft is configured as a tapered, forward plug portion, which fits in and snugly occupies a correspondingly shaped plug receptacle portion of the firearm barrel bore. The length of the shaft lying between the forward plug end and the actuator knob is provided with interrupted threads, that is, around the circumference of the shaft, there are two opposed flat areas (without threads) and two rounded, opposed areas provided with aligning screw threads. The interrupted threads allow the breech plug to be rapidly locked or unlocked by a partial turn of the breech plug. In operation, to insert the breech plug into the barrel bore breech end, the barrel assembly is moved to its open position, as described above, where the breech end of the barrel lies pivoted up and away from the breech block, for user access. The breech plug is aligned with the barrel bore (which is correspondingly shaped to operationally receive the breech plug), and inserted into the breech, forward plug end first. Once the breech plug reaches its forward limit of travel, the knurled actuator knob, lying outside and proximate the breech end of the barrel bore, is hand turned a quarter turn (e.g., 90°). This engages the interrupted threads of the breech plug with corresponding internal threads of the barrel bore. When locked, the forward plug end of the breech plug occupies the interior of the barrel, enclosing a chamber at the rear of the barrel and enabling powder and a projectile to be loaded into the muzzle end of the barrel. The interrupted threads serve to securely maintain the breech plug in place, whereas the actuator knob abuts the breech end of the barrel for hand access and removal of the breech plug when it is desired to clean or otherwise access the barrel bore. The breech plug is provided with a rear primer pocket, located in the center of the actuator knob, for holding a primer charge, and a central, small-diameter flash passage/aperture, extending longitudinally through the breech plug, for passage of the primer flash from the primer pocket to the chamber.

In another embodiment, the rapid release breech plug includes one or more O-ring seals for substantially reducing the amount of residue/fouling extant on the breech plug threads subsequent discharge. O-ring seals may be located at the forward plug end of the breech plug, and at the rear end of the threaded shaft portion, at the junction where it meets the fore edge of the knurled actuator knob.

BRIEF DESCRIPTION OF THE DRAWINGS

The present invention will be better understood from reading the following description of non-limiting embodiments, with reference to the attached drawings, wherein below:

FIGS. 2A and 10 are sectional side views of the firearm shown in FIG. 1A, while

DETAILED DESCRIPTION

Figure 1A:
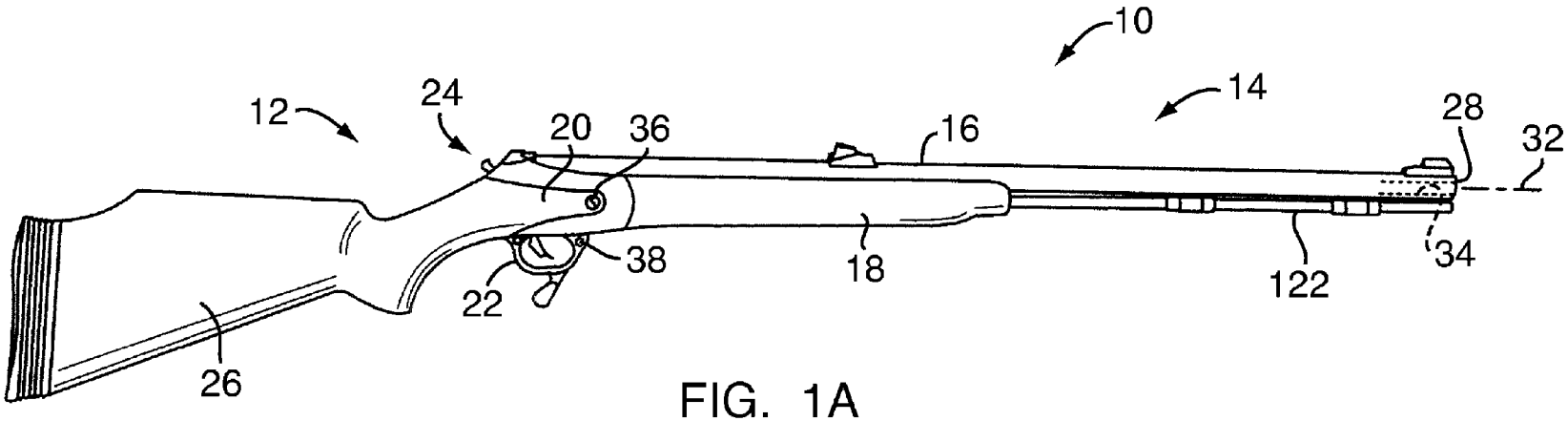
FIGS. 1A and 1B are side views of a firearm with the action closed and open, respectively, according to an embodiment of the present invention.

With reference to FIGS. 1A-10, an embodiment of the present invention relates to a muzzle loading handheld firearm 10 having a rear stock and support frame assembly 12 and a barrel assembly 14 pivotally linked to the stock assembly 12. The barrel assembly 14 includes a barrel 16 and a forestock 18 connected to the barrel. The stock assembly 12 includes a receiver or frame 20, a trigger guard 22, a firing mechanism 24, and a rear stock 26. The barrel 16 has a muzzle end face 28 and a breech end face 30, each perpendicular to an axis 32 defined by a rifled bore 34 extending longitudinally down the length of the barrel. The barrel assembly 14 is pivotally connected to the stock assembly 12 by a pivot bolt 36, and the trigger guard 22, acting as a user-actuated lever arm for moving the barrel assembly between closed and open positions, is pivotally connected to the barrel assembly 14 by a first removable pivot pin 38. A breech plug 40 encloses the breech end of the barrel 16, in a manner discussed in more detail below.

Figure 1B:
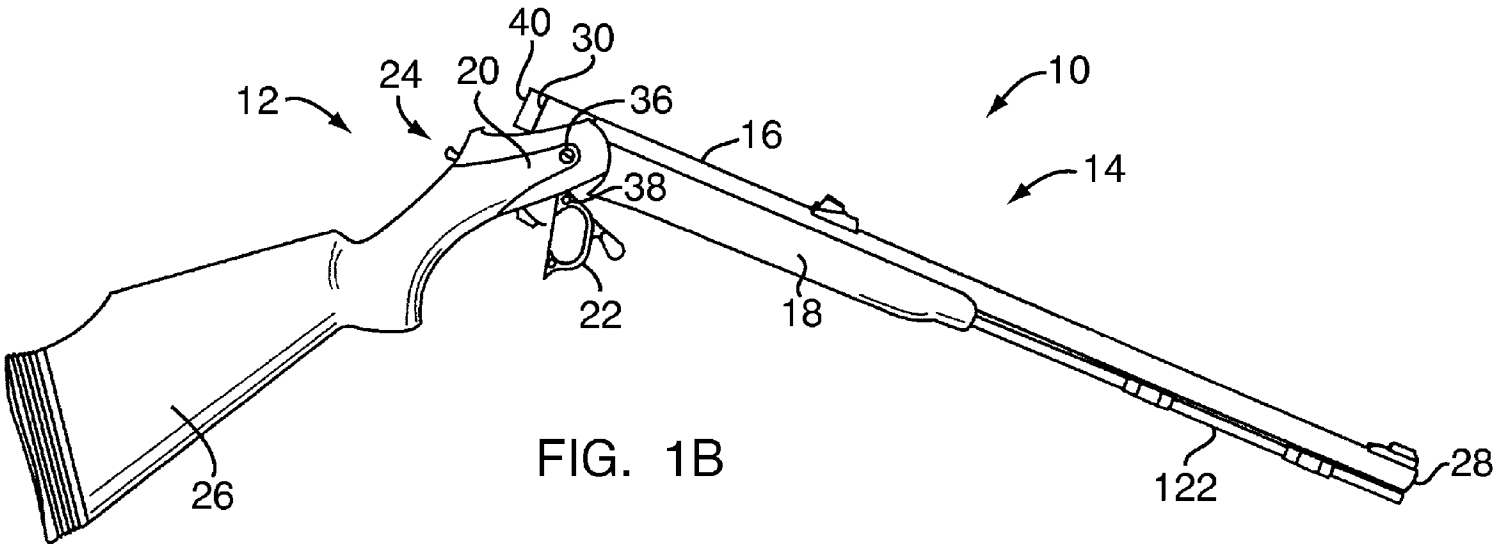

FIGS. 1A and 1B show the firearm 10 in the action-closed and action-open positions, respectively. In the closed position, the barrel assembly 14 and stock assembly 12 are oriented for user discharge of the firearm. For example, in this position the barrel 16 is generally aligned with the stock 26, for a user to hold the firearm in a conventional manner for firing, and for directing recoil force along the axis of the stock once the firearm is discharged. For moving the barrel assembly 14 to the open position, for accessing the breech end 30 of the barrel 16 and the breech plug 40, the trigger guard 22 is pivoted in a counter-clockwise direction (from the perspective of FIGS. 1A and 1B). Because the trigger guard 22 is linked to the barrel assembly 14 as a pivoting lever arm, as discussed in more detail below, this causes the barrel assembly 14 to pivot down, tilting the breech end of the barrel away from the stock assembly 12, as shown in FIG. 1B. In this position, with the action open, the breech end 30 of the barrel is fully accessible for cleaning or other servicing, or for outfitting the breech plug with a primer charge. Additionally, the pivoted barrel assembly provides a clear visual indication, even at a distance, that the rifle is in a safety condition, unable to be discharged.

Figure 2A:
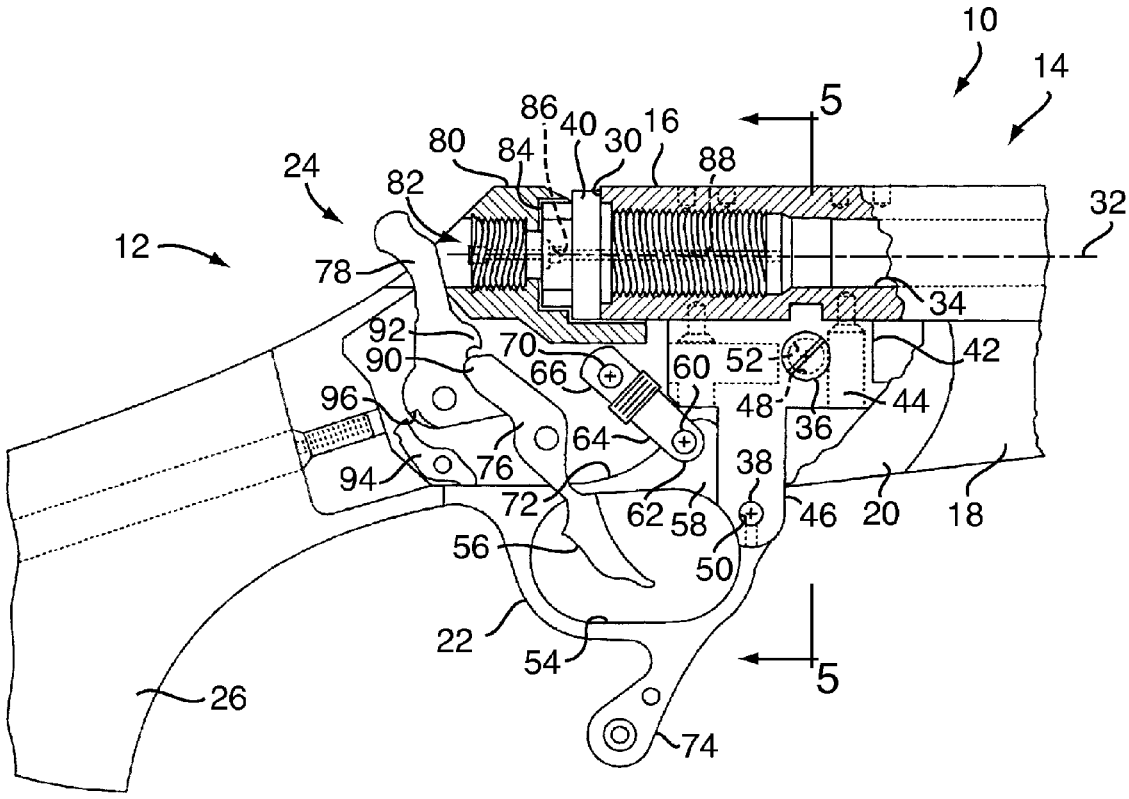
Figure 2B:
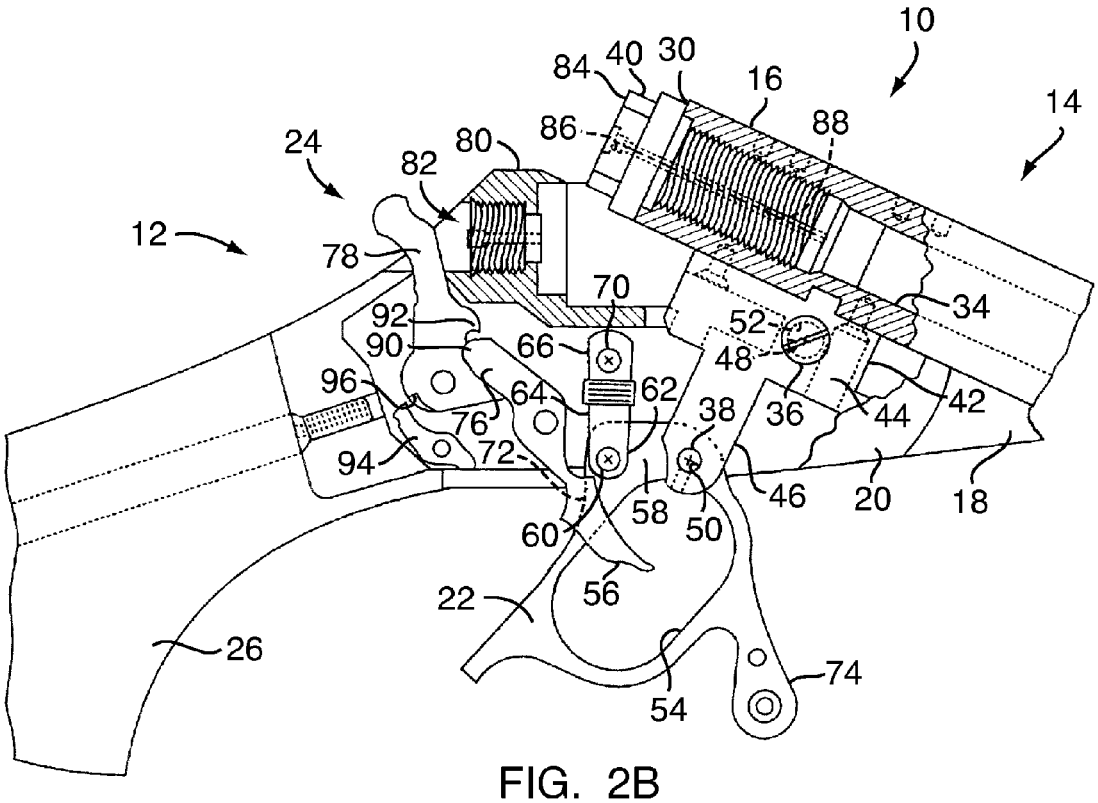
FIG. 2B is a sectional side view of the firearm as shown in FIG. 1B.
Figure 5:
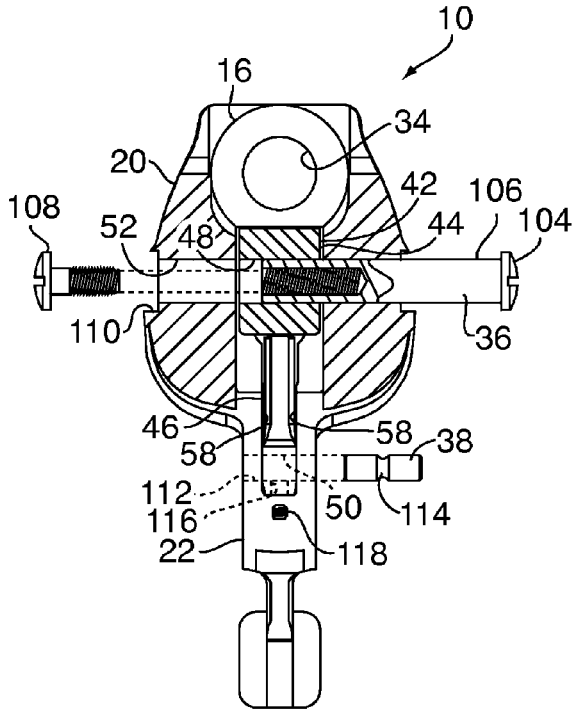
FIG. 5 is an axial sectional view of the firearm, taken along line 5-5 in FIG. 2A.

FIGS. 2A and 2B also show the internal operational mechanisms of the firearm in the closed and open positions of the barrel assembly, respectively. As indicated in FIG. 2A (see also FIG. 6A), the barrel 16 includes a downwardly depending, rigid lug 42 having a body portion 44 and an arm portion 46. The body portion 44 is connected to an underside of the barrel 16 at a position just forward of the breech end 30 of the barrel 16. The arm 46 extends down from the body portion 44. The body portion 44 defines a first transverse bore 48 located proximate to the barrel 16. (The bore 48 is laterally spaced apart from the barrel.) A second, smaller transverse bore 50 is formed through the arm portion 46 of the lug 42, forward of the breech by a lesser distance than the first bore 48. The receiver 20 includes a transverse bore 52 registered with the first bore 48 of the lug body 44. The pivot bolt 36, which may be a shouldered bolt as shown in FIG. 5, is closely received in the bores 48, 52 to secure the barrel assembly 14 to the receiver and rear stock assembly 12, as discussed in further detail below.

The trigger guard 22 serves as user-actuated lever arm for moving the barrel assembly 14 between the action-open position (FIG. 1B) and the action-closed position (FIG. 1A), and for securing the barrel assembly in the closed position. The trigger guard 22 defines a central transverse major opening 54 in which a trigger lever 56 is exposed, and through which the user's finger may pass when prepared to discharge the firearm 10. The guard 22 generally occupies a vertical medial plane of the rifle, and has a medial slot at the forward and upper portions, bounded by inward facing slot surfaces 58. The slot enables the end of the lug arm 46 to closely fit between the surfaces 58. (Put another way, the trigger guard 22 includes one or more medial slots that accommodate the lug arm 46 and trigger 56.) The lug arm 46 is pivotally attached to one side of an upper portion of the trigger guard 22 by the first pivot pin 38, which is received in a corresponding aperture provided in the trigger guard 22. Additionally, the other side of the trigger guard's upper portion receives a second transverse pivot pin 60 that is closely received in a first end 62 of a pivoting, adjustable link arm 64. (The link has an adjustable length as described in regards to a similar component in U.S. Pat. No. 6,604,311.) The link arm 64 has an opposed second end 66 defining a bore that receives a third transverse pivot pin 70 that is secured to the receiver 20. Note that the trigger guard 22 is pivotally connected to the lug arm 46 and to the adjustable link 64 by way of pivot pins 38 and 60, respectively, both of which establish moving pivot points. (The pivot points to the receiver 20, which are established by the pivot bolt 36 and third pivot pin 70, are non-moving pivot points.) The trigger guard 22 is not otherwise connected to the firearm 10, except to the extent that it may be configured to frictionally engage the underside of the firearm when in the closed position.

Essentially, the barrel lug 42, trigger guard 22, adjustable link 64, and receiver 20 form the four components of a four bar linkage, with the adjustable link 64 providing an adjustable over-center action that locks the trigger guard 22 into the closed position shown in FIGS. 1A and 2A, and without requiring excessive force to deliberately unlock the action. In operation, from the closed position, the trigger guard 22 is pivoted downwards about the first pivot pin 38 connected to the barrel assembly lug arm 46. This in turn causes the lug arm 46 to move generally upwards, and the lug 42 to pivot about the pivot bolt 36 in the opposite direction. (For example, from the perspective of FIGS. 2A and 2B, the trigger bar is pivoted clockwise, and the lug 42 pivots counter-clockwise.) At the same time, the trigger guard 22, pivotally connected to the adjustable link 64 by the second pivot pin 60, causes the adjustable link 64 to pivot clockwise about the third pivot pin 70. The link 64 can be thought of as a moving lever point, for maintaining the trigger guard 22 in the proper orientation for levering the lug 42 about the pivot bolt 36 as the trigger guard is pivoted downwards. In effect, the link 64 establishes a pivotal arc of movement of the trigger guard 22 for pivoting the barrel assembly about the pivot bolt 36 between the closed and open positions.

As the lug arm 46 is caused to pivot about the pivot bolt 36, since the pivot point of the pivot bolt 36 is fixed with respect to the receiver 20, the barrel 16 tilts out of alignment with the stock assembly 12. Once the trigger guard 22 reaches the maximum limit of its range of travel in this direction, the firearm action lies in its fully open position, as shown in FIGS. 1B and 2B. Here, the breech end 30 of the barrel 16 lies tilted up and away from the stock assembly, with the stock assembly being clear of the rear of the barrel, for user access to the breech plug and breech end of the barrel. Nothing occupies the cylindrical space extending rearward of the barrel along the bore axis 32, with a diameter defined by the largest portion of the breech plug or bore, whichever is greater. The range of travel of the trigger guard 22 in the action-open direction may be defined by a limiting interaction between one or more of the moving components (e.g., trigger guard 22, adjustable link 64, lug 42, and barrel assembly 12) and another moving or non-moving component, e.g., a receiver stop shoulder that blocks one of the moving components.

The configuration and positioning of the adjustable link 64 and lug arm 46 serve to frictionally lock the trigger guard 22 and barrel assembly 14 in the closed position. In particular, when the action is in the closed position (see FIG. 2A), the adjustable link 64 is positioned to rest slightly forward of a line connecting the lug arm pivot 38 and the third transverse pivot pin 70 (e.g., the pivot pin 60 lies between this line and the pivot bolt 36), which provides a slight over-center resistance. A degree of force must be applied to the trigger guard 22 to overcome this resistance, for pivoting the link 64 towards the open position (see FIG. 2B). Also, the initial pivotal force acted upon the link 64 is directed generally along the axis of the link 64 (as opposed to a force more normal to the link axis), which enhances this effect.

The trigger guard 22 may also be provided with a rounded upper engagement surface 72 that friction fits with a corresponding surface provided in the receiver/stock assembly, e.g., the two surfaces are positioned for there to be a moderate frictional press fit between the two when the trigger guard is moved to the closed position. Additionally, the trigger guard 22 may be outfitted with a downwardly depending extension 74 that provides leverage for unlocking and locking the guard 22 between the open and closed/locked positions.

The receiver 20 further includes mounted pivot pins for mounting a pivoting trigger 76 and a hammer 78. Integral with the receiver is a breech block 80, which includes a firing pin assembly 82. The breech block 80 abuts a rear face 84 of the breech plug 40, for containing a primer charge residing in a primer pocket 86 centrally defined in the breech plug. A small-diameter flash passage 88, coaxial with the barrel axis 32 and breech plug 40, extends through the breech plug 40 from the pocket 86 to the interior of the breech end of the barrel. When the barrel assembly 14 is fully closed, the firing pin assembly 82, primer pocket 86, flash passage 88, and barrel bore 34 are coaxially aligned.

Figure 3:
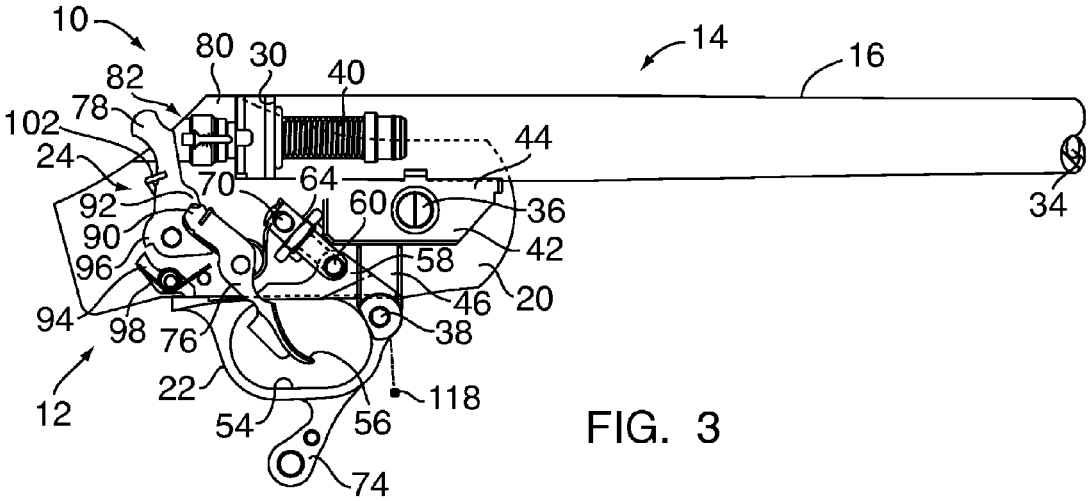
FIGS. 3 and 4A-4D are sectional side views of another embodiment of the firearm, showing various operational stages of the firearm.
Figure 4A:
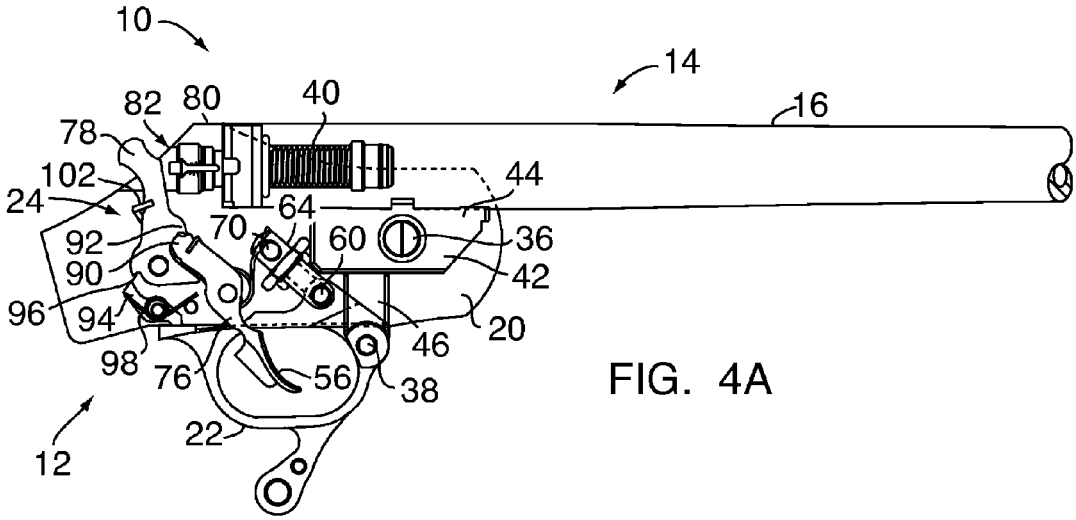
Figure 4B:
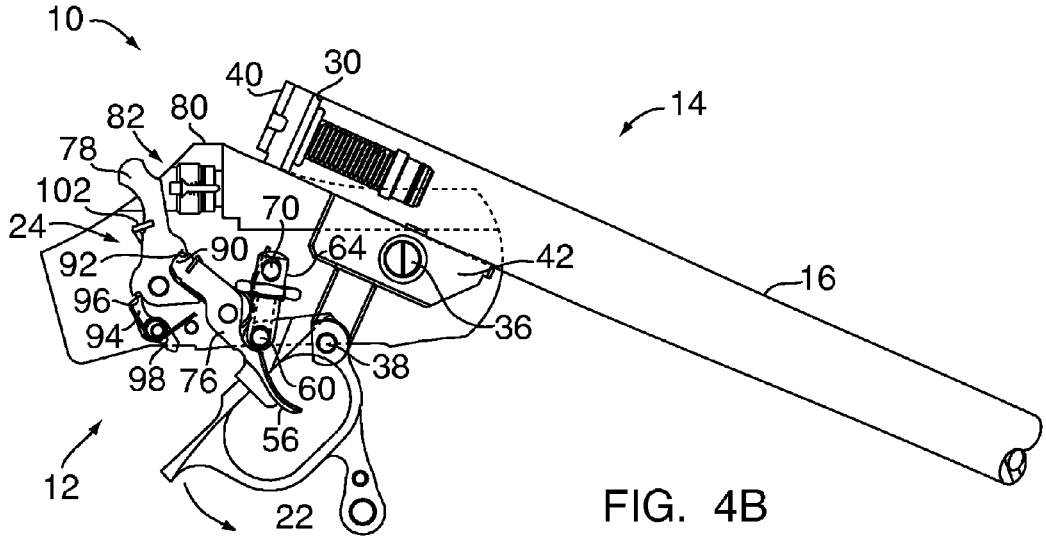

FIGS. 3 and 4A-4D show various operational stages of the firearm 10, as well as additional safety features of the firearm. FIGS. 3 and 4A show the firearm in the action-closed position, with the hammer 78 "at rest," i.e., un-cocked. (FIG. 3 is provided for showing the firing mechanism components relative to the adjustable link 64, which is otherwise only shown schematically in FIGS. 4A-4C.) The hammer 78 lies away from the firing pin assembly 82, in a safety position where an automatic hammer block portion 90 of the trigger 76 engages a corresponding lip 92 provided as part of the hammer 78. This prevents the hammer from contacting the firing pin assembly 82. (The hammer block 90 and lip 92 are shown out of engagement in FIGS. 4C and 4D.) FIG. 4B shows the firearm in the action-open position. Here, the firing mechanism 24 lies generally in the same position as when the action is closed. However, when the trigger guard 22 is pivoted downwards to open the action, a hammer interlock arm 94 pivots into engagement with a lip-like engagement flat 96 provided as part of the hammer 78, on the rear of the hammer opposite the hammer block lip 92. This prevents the hammer 78 from being pivoted rearwards into a cocked position. A torsion spring 98 is operably attached to the interlock arm 94 to automatically move it into the locking position shown in FIG. 4B.

When the action is open, the hammer 78 is held immobile—the hammer block portion 90 of the trigger 76 prevents the hammer from pivoting into engagement with the firing pin assembly 82, and the hammer interlock arm 94 prevents the hammer from being cocked. When the trigger guard 22 is moved back to the closed position, as shown in FIG. 4A, a rear end surface of the trigger guard presses up against one end of the interlock arm 94, causing it to disengage from the hammer engagement flat 96. The hammer block 90 still prevents the hammer 78 from contacting the firing pin assembly, but the hammer 78 may be manually moved to a cocked position.

Figure 4C:
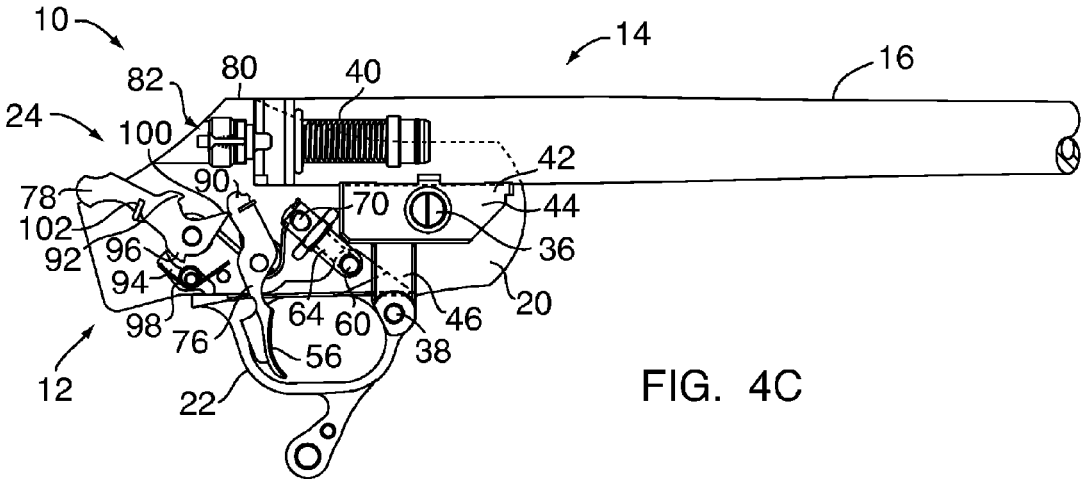
Figure 4D:
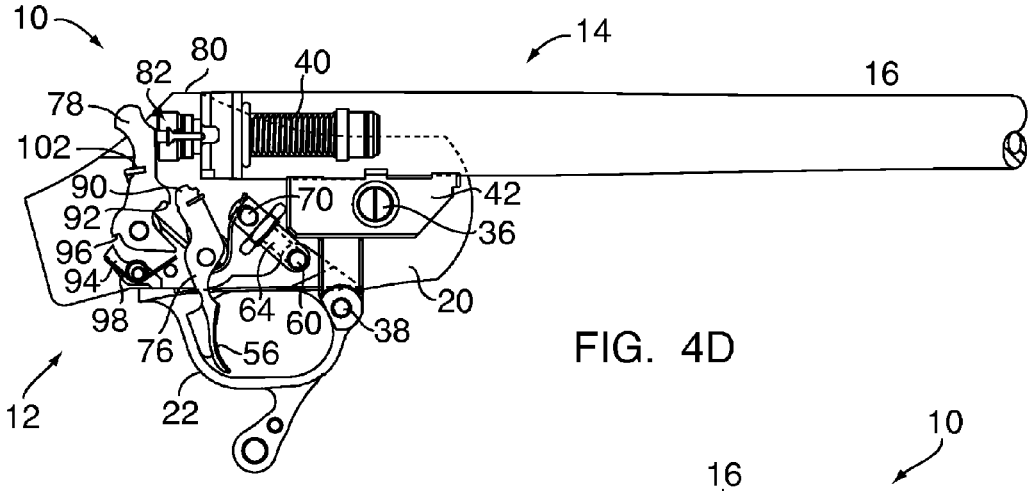

FIG. 4C shows the hammer 78 in the partially cocked position. As the hammer 78 is drawn manually rearwards, the trigger 76 engages the hammer along a sear surface 100, and the trigger pivots rearward from its "at rest" position. Once the hammer 78 reaches its fully rearward position, it is blocked from moving by the trigger 76, and lies in a fully cocked position. When the trigger 76 is pulled fully rearwards by the user's finger, as shown in FIG. 4D, the upper part of the trigger pivots out of engagement with the hammer 78. This allows the hammer 78, under the driving force of a hammer torsion spring 102, to pivot forwards into engagement with the firing pin assembly 82. Assuming the breech plug has been outfitted with a primer charge, this causes the firing pin assembly 82 to ignite the primer charge. The flash from primer charge passes though the flash passage 88 in the breech plug 40. If the barrel is loaded with a propellant (e.g., black powder or a black powder substitute) and a projectile, the primer flash ignites the propellant, causing the projectile to exit the muzzle end of the barrel.

Figure 7:
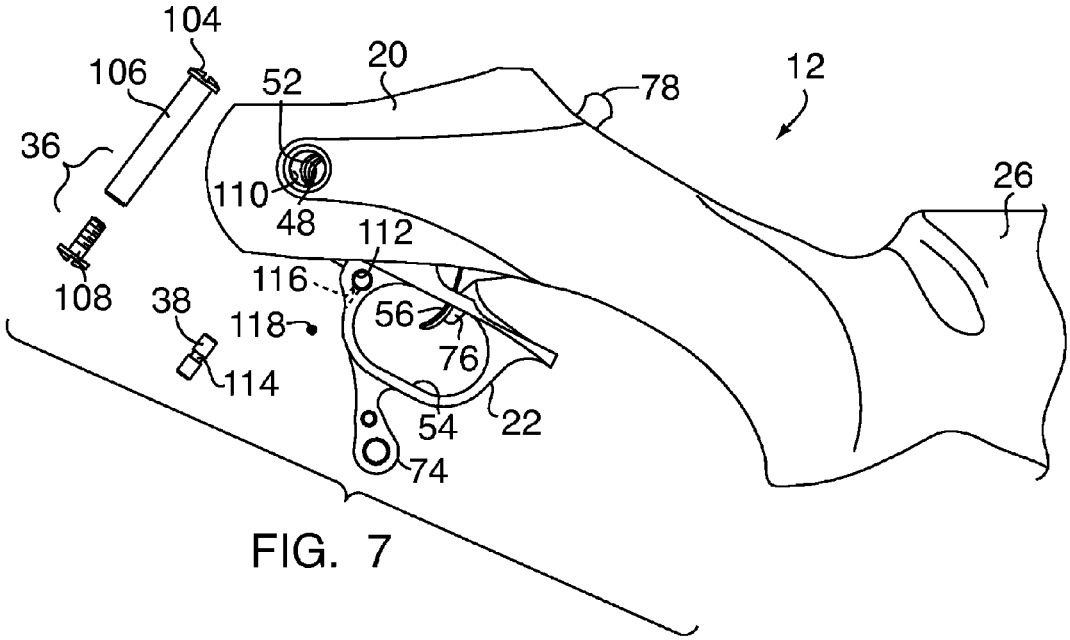
FIG. 7 is a side view of a rear stock assembly portion of the firearm.

FIGS. 5 and 7 show one embodiment of a means for securing the pivot bolt 36 and the first pivot pin 38. The pivot bolt 36 is a shouldered bolt with a head 104 and an extending straight cylindrical shaft 106 functioning as the bearing surface of the pivot bolt. The distal end of the shaft 106 defines a threaded bore that receives a machine or other headed screw 108. The heads reside in countersunk recesses 110 provided in the receiver, which keep the heads flush with or below the receiver surface. With a close slip-fit, the pivot bolt 36 limits the barrel and receiver to pivoting only about the pivot bolt axis.

The lug arm pivot pin 38 extends through the transverse bore 50 (formed through the lug arm 46) and a corresponding, aligned bore 112 formed though the trigger guard 22. The pivot pin 38 provides a close slip fit through the aligned bores 50, 112 to constrain unwanted lateral motion. The pivot pin 38 is necked down at its midpoint 114. The lug arm 46 has a threaded set screw bore 116 that extends from arm's transverse bore 50 perpendicularly through to the end of the arm 46, and which receives an Allen screw or other set screw 118. The nose of the set screw 118 protrudes into the pivot pin neck 114, to securely retain the pin in place. The ends of the set screw 118, lug arm pivot pin 38, and pivot bolt 36 are exposed when the firearm 10 is fully assembled. As such, these elements may be removed for detaching the barrel assembly 14 from the receiver and stock assembly 12, for cleaning and other service, without having to remove the rear stock 26. De-attaching the forestock 18 from the barrel 16 is optional.

Figure 6A:
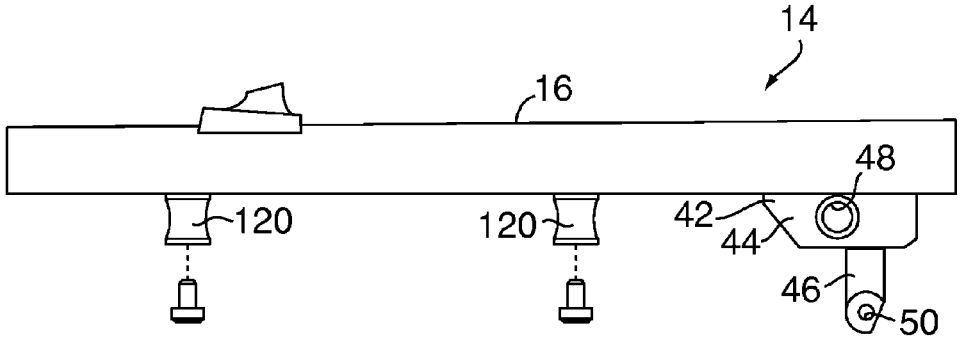
FIGS. 6A and 6B are side views of a barrel assembly portion of the firearm.
Figure 6B:
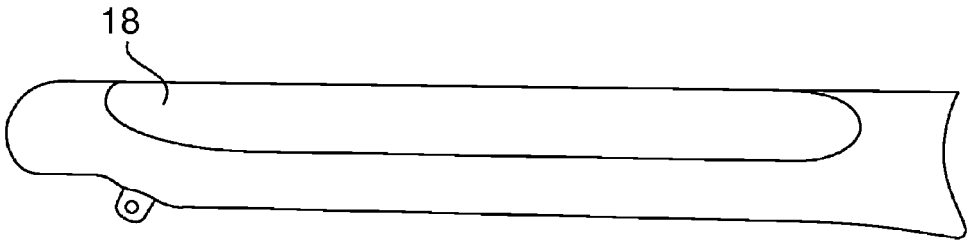

The barrel 16 and forestock 18 are additionally shown in FIGS. 6A and 6B, respectively. As indicated, the barrel includes attachment protuberances 120 for attaching the forestock 18 to the barrel. The forestock 18 includes complementary bores/apertures for receiving the protuberances. As shown in FIGS. 1A and 1B, the forestock and/or barrel may be provided with standard features for holding a ramrod 122.

FIGS. 8A-8D show an embodiment of the breech plug 40, as configured for hand-actuated rapid removal from the breech end of the barrel 16. The breech plug 40 includes a shaft portion 130 and a knurled actuator knob 132, which is attached to the rear end of the shaft. The fore end of the shaft is configured as a tapered, forward plug portion 134, which fits in and snugly occupies a correspondingly shaped plug receptacle portion of the firearm barrel bore. (That is, the barrel bore is complementary in shape to the breech plug 40, so that when the breech plug is inserted and locked in place, the breech plug blocks the barrel bore except for the flash passage 88.) The length of the shaft between the forward plug portion 134 and the actuator knob 132 is provided with interrupted threads 136. The interrupted threads 136 include two rounded areas provided with aligning screw threads 140*a*, 140*b*, which lie on opposite sides of the shaft. The areas of screw threads 140*a*, 140*b* are defined by two generally parallel, generally flat landings 138*a*, 138*b* (without threads) lying on opposite sides of the shaft between the screw threads 140*a*, 140*b* and extending longitudinally down the length of the shaft, or portion thereof. The interrupted threads 136 allow the breech plug 40 to be rapidly locked or unlocked by a partial turn of the breech plug, typically 90°. (In this context, the term "rapid" refers to engaging or disengaging the screw threads of the breech plug from the complementary screw threads of the barrel bore in less than a 360° turn of the breech plug.) The breech plug additionally includes a primer pocket 86, located in the center of the knurled actuator, for holding a primer charge, and a central, small-diameter flash passage 88, extending longitudinally through the breech plug, for passage of the primer flash from the primer pocket to the barrel bore.

Figure 8A:
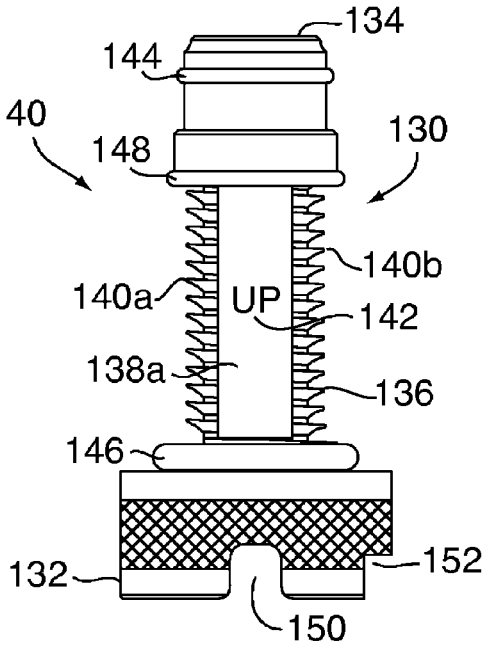
FIGS. 8A-8D are various views of a rapid release breech plug.
Figure 8B:
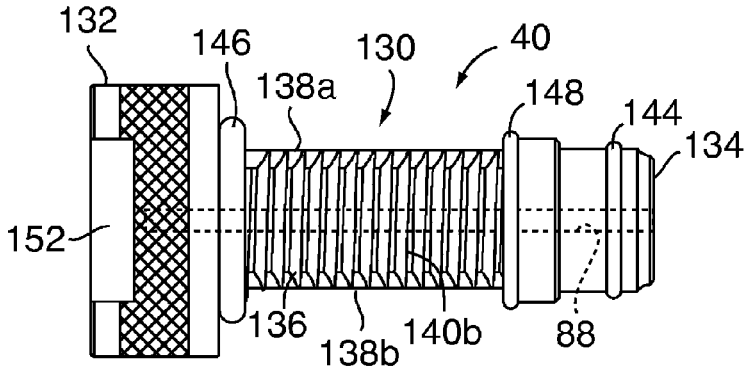
Figure 8C:
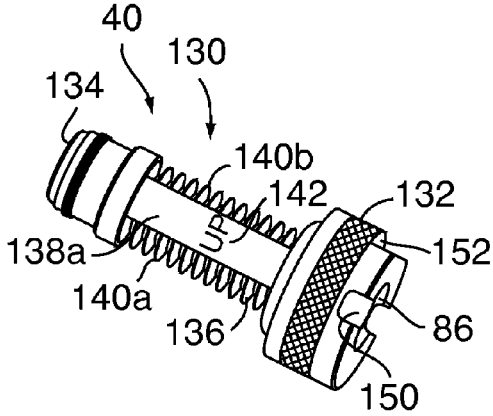
Figure 8D:
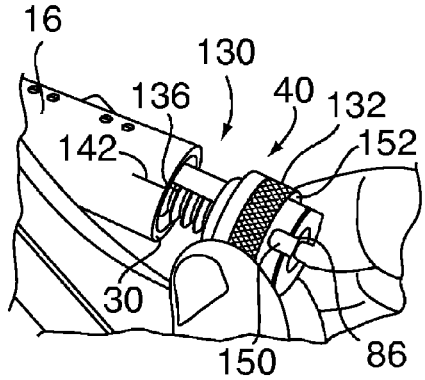

In operation, to insert the breech plug into the breech end of the barrel bore, the barrel assembly is moved to its open position, as described above, where the breech end 30 of the barrel lies pivoted up and away from the breech block 80, for user access. The breech plug 40 is aligned with the barrel bore 34, and inserted into the breech, forward plug end 134 first. (As shown in FIG. 8D, the breech plug 40 and barrel 16 may be provided with indicia 142 for informing users of how to orient the breech plug 40 for proper insertion into the barrel.) Once the breech plug reaches its forward limit of travel, the knurled actuator knob 132, lying outside and proximate the breech end of the barrel bore, is turned a quarter turn. This engages the interrupted threads of the breech plug with corresponding internal threads of the barrel bore. When locked, the forward plug end 134 of the breech plug occupies the interior of the barrel, enabling powder and a projectile to be loaded into the muzzle end of the barrel. The interrupted threads 136 serve to securely maintain the breech plug in place, whereas the knurled actuator knob 132 abuts the breech end 30 of the barrel, for hand access and removal of the breech plug when it is desired to clean or otherwise access the barrel bore.

The rapid release breech plug 40 may include one or more O-ring seals 144, 146, 148 for substantially reducing the amount of residue/fouling extant on the breech plug threads subsequent discharge of the firearm. One O-ring seal 144 is located at the forward plug end of the breech plug. A second O-ring seal 146 is located at the rear end of the threaded shaft portion, at the junction where it meets the fore edge of the knurled actuator knob. A third O-ring seal 148 is located at the junction between the fore end of the interrupted threads 136 and the forward plug portion 134. The O-rings compensate for any slight spaces that might exist between the breech plug body and the barrel due to mechanical tolerances. Thus, when the firearm 10 is discharged, powder residue and other gases are generally prevented from passing rearwards into the thread area of the breech plug, which significantly reduces fouling. This enables the breech plug 40 to be easily removed by hand, and reduces the need to clean the breech plug. The knurled end portion 132 of the breech plug 40 may be provided with a tool cross slot 150 for using a screwdriver or wrench-type device to remove the plug, which may be needed if the plug is heavily fouled or otherwise stuck.

Figure 9A:
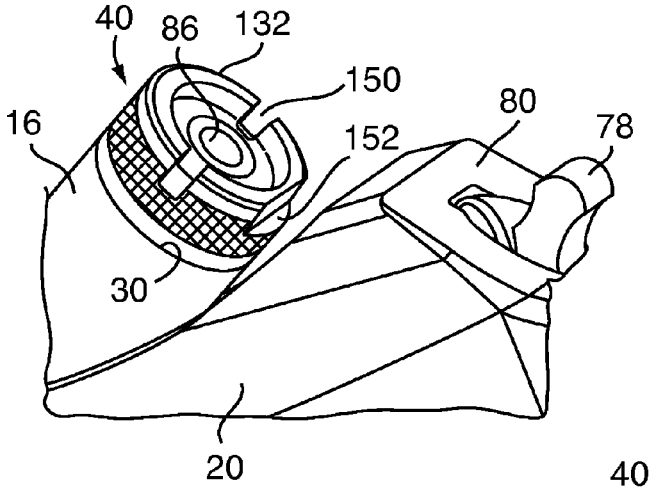
FIGS. 9A and 9B are perspective views of a safety alignment feature of the breech plug and rear stock assembly.
Figure 9B:
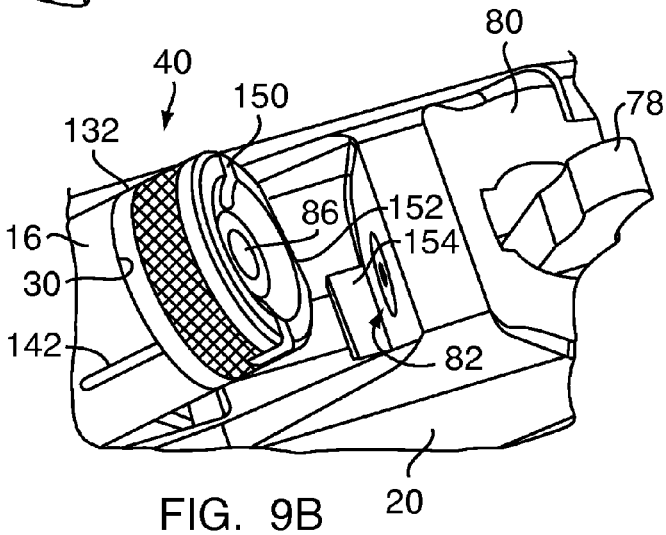

FIGS. 9A and 9B are perspective views of a safety alignment feature of the breech plug and rear stock assembly. As shown, the actuator knob portion 132 of the breech plug 40 is provided with a lateral end recess 152, which includes a flat surface that lies perpendicular to the end plane of the breech plug. The end recess 152 mates with a rectangular step or other protuberance 154 attached to the bottom of the receiver 20, at the junction of the receiver and the breech block 80, where the breech end of the barrel is received when the firearm action is in the closed position. (As shown in the drawings, the top of the receiver 20 is contoured for removably cradling the breech end of the barrel when the barrel assembly is in the action-closed position.) The step 154 prevents the barrel assembly 14 from being moved into the fully closed position unless the breech plug 40 is properly and fully set in the barrel. If the breech plug 40 is not fully inserted into the barrel and locked into place, the recessed flat surface 152 will lie rotated out of parallel alignment with the step. In such a case, if the user attempts to close the action, the side of the actuator knob 132 away from the lateral end recess 152 will strike the step 154, preventing the action from being fully closed. This prevents the firing pin assembly 82 from aligning with the breech plug primer pocket 86 and the firearm from being discharged.

Although the safety alignment feature in FIGS. 9A and 9B is shown as including a lateral end recess in the knurled breech plug knob and a corresponding-shaped step attached to the receiver, other complementary engagement features may be used instead. For example, the breech plug could be provided with a wedge-shaped protuberance (or other first engagement feature) and the receiver could be outfitted with a corresponding-shaped, wedge-type indent (or other second engagement feature) into which the wedge-shaped protuberance would fit when the breech plug was locked in place in the breech end of the barrel.

As should be appreciated, the breech plug may be configured in different ways than as described above with respect to FIGS. 8A-8D. For example, as shown in FIGS. 2A and 2B, the breech plug may have non-interrupted threads.

The pivot assembly of the firearm 10, including the barrel lug 42, lever arm trigger guard 22, and pivoting adjustable link 64 (which operate in conjunction with a firearm receiver 20) provide a simplified yet robust mechanism for a break-open action, which can be adapted for use with different firearms, including muzzle loaders, shotguns, and the like. As explained above, the lug is attached to the firearm barrel. The lug and barrel are pivotally attached to the receiver at a first pivot location (e.g., the pivot bolt) that extends though the lug. The lug includes an arm portion located on the opposite side of the first pivot location from the barrel. (The lug arm acts as a lever for pivoting the barrel about the pivot point.) The trigger guard lever arm is pivotally attached to the lug arm at a second pivot location, and is manually accessible for user actuation. The adjustable link is pivotally attached to the receiver at a third pivot location and to the lever arm at a fourth pivot location. The link establishes a pivotal arc of movement of the lever arm for pivoting the lug and barrel about the first pivot location between the action-open position and the action-closed position. As should be appreciated, the receiver, lug, lever arm, and link together form a four-bar linkage for moving the barrel between the action-open and action-closed positions. The elements in the four-bar linkage comprise the only components of the firearm for moving the barrel between the action-open and action-closed positions.

Figure 10:
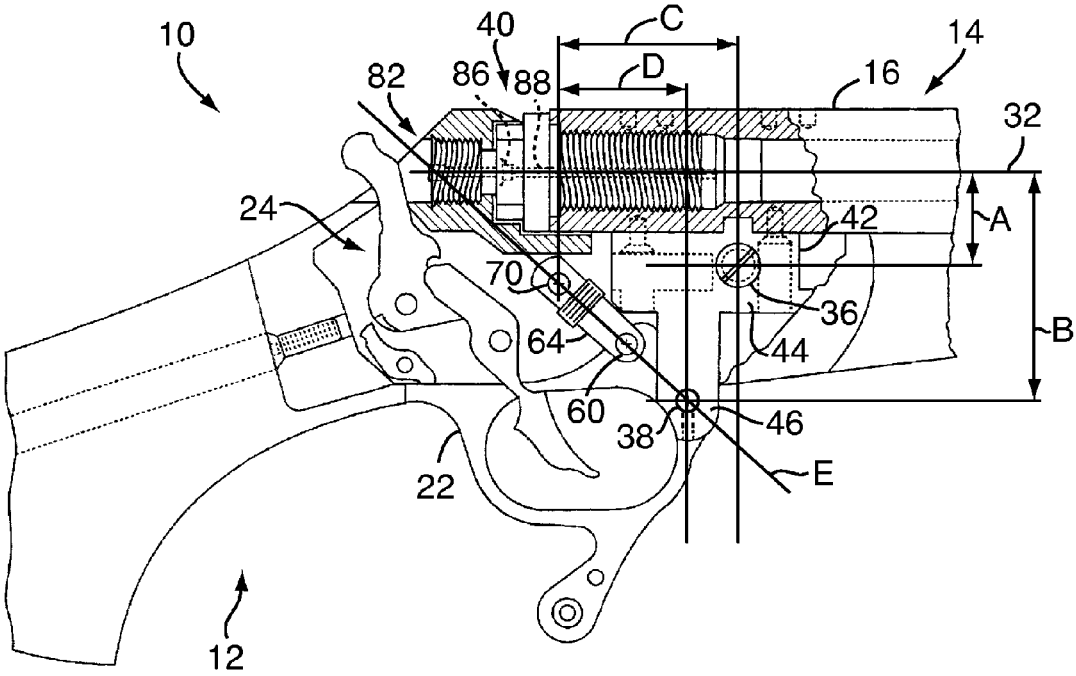

The geometry of one embodiment of the four-bar linkage is illustrated in FIG. 10. As shown, the pivot bolt 36 lies closer to the axis of the barrel 16 than the pivot pin 38 (distance A versus distance B), but farther away from the breech end of the barrel (distance C versus distance D). Pivots 38 and 70 define an axis E, which is oriented at about 45° with respect to the barrel axis 32 when the action is closed. Pivot 60 of the link 64 lies slightly off-center, between the axis E and the pivot bolt 36. The trigger guard 22, lug arm 46, and pivot link 64 act as a compound lever system for providing the same amount of force for pivoting the barrel 16 about the pivot bolt 36 as a very long lever arm would (e.g., a lever arm extending much farther out from the barrel axis than the trigger guard), but in a much shortened, compact space.

Although the barrel pivot lug 42 (including the lug body and lug arm) has been illustrated as being a separate element removably attached to the barrel, the lug could instead be permanently attached to the barrel, or it could be integral with the barrel, e.g., integrally formed with the barrel during casting or machining of the barrel. In any such case, the term "pivot lug" encompasses any element that establishes a pivot (of the barrel/barrel assembly) that lies off axis of the barrel.

Since certain changes may be made in the above-described muzzle loading firearm with break-open action, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A muzzle loading firearm comprising:

a barrel assembly having a barrel and a breech plug, said barrel defining a longitudinal bore and having a muzzle end and a breech end, and said breech plug being removably attached to the breech end of the barrel to enclose the rear of the bore;

a rear stock assembly pivotally connected to the barrel assembly at a first pivot location, wherein the barrel assembly is moveable with respect to the stock assembly between an open position in which the breech end of the barrel is accessible for service and a closed position in which the breech end of the barrel is inaccessible for service and the firearm is secured for discharge; and a user-actuated lever arm operably connected to the stock assembly and to the barrel assembly for allowing for movement of the barrel assembly between the open and closed positions, wherein the lever arm is a trigger guard of the firearm, said trigger guard lying in a closed position against the stock assembly when the barrel assembly is in the closed position.

2. The firearm of claim 1 further comprising:

an interlock arm attached to and located within a receiver portion of the stock assembly, said interlock arm being moveable between a first position where the interlock arm engages a hammer portion of the firearm and prevents the hammer portion from being moved to a cocked position, and a second position where the interlock arm is disengaged from the hammer portion;

wherein the lever arm is configured to move the interlock arm to the second position when the lever arm is moved to the closed position of the barrel assembly; and wherein the interlock arm automatically moves to the first position when the lever arm is moved to pivot the barrel assembly out of the closed position.

3. The firearm of claim 2 wherein a trigger portion of the firearm, pivotally attached to and located within the receiver, is configured to block the hammer from contacting a firing pin portion of the firearm unless and until the hammer is moved to the cocked position.

4. The firearm of claim 1 further comprising:

a firing mechanism having a hammer and a trigger for actuating the hammer, said hammer and trigger being pivotally attached to a receiver portion of the stock assembly; and an interlock arm pivotally attached to the receiver;

wherein the interlock arm and trigger are configured to hold the hammer generally immobile when the lever arm is moved out of the closed position.

5. A muzzle loading firearm comprising:

a barrel assembly having a barrel and a breech plug, said barrel defining a longitudinal bore and having a muzzle end and a breech end, and said breech plug being removably attached to the breech end of the barrel to enclose the rear of the bore;

a rear stock assembly pivotally connected to the barrel assembly at a first pivot location, wherein the barrel assembly is moveable with respect to the stock assembly between an open position in which the breech end of the barrel is accessible for service and a closed position in which the breech end of the barrel is inaccessible for service and the firearm is secured for discharge; and a user-actuated lever arm operably connected to the stock assembly and to the barrel assembly for allowing for movement of the barrel assembly between the open and closed positions, the barrel assembly further comprises a lug arm attached to the barrel and extending past the first pivot location opposite the barrel; and the lever arm is pivotally connected to the lug arm at a second pivot location and to a link arm at a third pivot location, said link arm being pivotally attached to the stock assembly at a fourth pivot location, and said link arm establishing a pivotal arc of movement of the lever arm for pivoting the lug arm and barrel assembly about the first pivot location between the closed and open positions.

6. The firearm of claim 5 wherein the link arm lies in an over-center position when the barrel assembly is in the closed position, for frictionally locking the lever arm and barrel assembly in the closed position.

7. The firearm of claim 6 wherein the over-center position is defined by the third pivot location lying between the first pivot location and an axis defined by the second and fourth pivot locations.

8. The firearm of claim 6 wherein the over-center position is defined by the third pivot location lying between the first pivot location and an axis defined by the second and fourth pivot locations.

9. The firearm of claim 5 wherein the lever arm is pivotally connected to the barrel assembly and to a link arm, said link arm being pivotally connected to the stock assembly, and said link arm establishing a pivotal arc of movement of the lever arm for pivoting the barrel assembly about the first pivot location between the closed and open positions.

10. The firearm of claim 9 wherein the link arm lies in an over-center position when the barrel assembly is in the closed position, for frictionally locking the lever arm and barrel assembly in the closed position.

11. A muzzle loading firearm comprising:

a barrel assembly having a barrel and a breech plug, said barrel defining a longitudinal bore and having a muzzle end and a breech end, and said breech plug being removably attached to the breech end of the barrel to enclose the rear of the bore; and a rear stock assembly pivotally connected to the barrel assembly at a first pivot location, wherein the barrel assembly is moveable with respect to the stock assembly between an open position in which the breech end of the barrel is accessible for service and a closed position in which the breech end of the barrel is inaccessible for service and the firearm is secured for discharge, the breech plug includes a shaft portion and an actuator knob attached to a rear end of the shaft portion, said shaft portion being removably disposed in the breech end of the barrel bore, and said actuator knob lying outside the barrel bore proximate to the breech end of the barrel;

wherein the actuator knob is configured to be gripped by hand for manually removing the breech plug when the barrel assembly is in the open position; and wherein the actuator knob cannot be gripped by hand to remove the breech plug when the barrel assembly is in the closed position.

12. The firearm of claim 11 wherein the breech plug includes at least one O-ring seal disposed about the shaft portion and configured to create a seal with the barrel when the shaft portion is disposed in the breech end of the barrel bore.

13. The firearm of claim 11 wherein at least part of the breech plug shaft is provided with interrupted threads, said interrupted threads being configured to engage corresponding threads in the barrel bore and to lock the breech plug in place in the bore when the shaft is inserted in the bore according to a designated alignment and rotated a partial turn.

14. The firearm of claim 13 wherein the breech plug includes at least one O-ring seal disposed about the shaft portion and configured to create a seal with the barrel when the shaft portion is disposed in the breech end of the barrel bore.

15. The firearm of claim 13 wherein the interrupted threads comprise first and second threaded portions having aligning threads, said first and second threaded portions lying on opposite sides of the breech plug shaft and being separated by first and second generally flat landing portions respectively located between the threaded portions and lying on opposite sides of the breech plug.

16. The firearm of claim 11 wherein:

the actuator knob includes a first engagement feature; and an external surface of a receiver portion of the stock assembly, against which the actuator knob and breech end of the barrel rest when the barrel assembly is in the closed position, is provided with a second engagement feature complementary in shape to the first engagement feature, wherein the first and second engagement features align when the breech plug is locked in place in the barrel, allowing the barrel assembly to be moved into the closed position, and wherein the first and second engagement features are misaligned when the breech plug is not locked in place in the barrel, preventing the barrel assembly from being moved into the closed position.

17. A muzzle loading firearm comprising:

a barrel assembly having a barrel and a breech plug, said barrel defining a longitudinal bore and having a muzzle end and a breech end, and said breech plug being removably attached to the breech end of the barrel to enclose the rear of the bore; and a rear stock assembly pivotally connected to the barrel assembly at a first pivot location, wherein the barrel assembly is moveable with respect to the stock assembly between an open position in which the breech end of the barrel is accessible for service and a closed position in which the breech end of the barrel is inaccessible for service and the firearm is secured for discharge, wherein the breech plug is a rapid removal breech plug comprising:

interrupted threads for rapid locking and unlocking of the breech plug in the breech end of the barrel bore; and an actuator knob that lies external to the barrel bore, proximate to the breech end of the barrel, for hand removal of the breech plug from the barrel bore when the barrel assembly is in the open position.

18. A muzzle loading firearm comprising:

a barrel assembly having a barrel, a breech plug, and a pivot lug attached to the barrel, said barrel having a longitudinal bore and breech and muzzle ends, and said breech plug being removably attached to the breech end of the barrel to enclose the rear of the bore;

a rear stock assembly having a receiver with a breech block and a firing mechanism attached to the receiver, wherein the barrel assembly is pivotable about the pivot lug with respect to the stock assembly; and a lever arm assembly operably attached to the receiver and to the barrel pivot lug for user movement of the barrel assembly between an action-closed position of the barrel assembly and lever arm assembly, where the barrel and breech plug are aligned with the firing mechanism for discharge of the firearm, and an action-open position of the barrel assembly and lever arm assembly, where the barrel and breech plug lie tilted away from the breech block and firing mechanism for user access and removal of the breech plug.

19. The firearm of claim 18 wherein:

the breech plug includes an actuator knob lying outside the barrel bore proximate to the breech end of the barrel; and the firearm is configured for the knob to be gripped by hand for manually removing the breech plug when the barrel assembly is in the open position, and wherein the actuator knob cannot be gripped by hand to remove the breech plug when the barrel assembly is in the closed position.

20. The firearm of claim 18 wherein the lever arm assembly is configured to lock the barrel assembly in place when the barrel assembly is moved to the action-closed position.

21. The firearm of claim 20 wherein:

the lever arm assembly comprises a link arm and a lever arm, said link arm being pivotally attached to the receiver at a first end of the link arm and to the lever arm at a second end of the link arm; and the lever arm is pivotally attached to the barrel pivot lug, said lever arm being user accessible for moving the barrel assembly between the action-closed and action-open positions, wherein the link arm establishes a pivotal arc of movement of the lever arm for pivoting the barrel assembly about the pivot lug.

22. The firearm of claim 21 wherein the receiver, pivot lug, lever arm, and link arm together form a four-bar linkage for moving the barrel assembly between the action-open and action-closed positions, said four-bar linkage being the only components of the firearm for moving the barrel assembly between the action-open and action-closed positions.

23. The firearm of claim 21 wherein the link arm lies in an over-center position when the barrel assembly is in the action-closed position, for frictionally locking the lever arm and barrel assembly in the action-closed position.

24. The firearm of claim 18 wherein:

the firing mechanism includes hammer and a trigger for actuating the hammer; and the firearm further comprises an interlock arm pivotally attached to and located within the receiver, wherein the interlock arm and trigger are configured to hold the hammer generally immobile when the lever arm is moved to pivot the barrel assembly out of the action-closed position, said lever arm moving the interlock arm out of engagement with the hammer when the lever arm is moved into the action-closed position.

25. The firearm of claim 18 wherein the breech plug is a rapid removal breech plug comprising:

interrupted threads for rapid locking and unlocking of the breech plug in the breech end of the barrel bore; and an actuator knob that lies external to the barrel bore, proximate to the breech end of the barrel, for hand removal of the breech plug from the barrel bore when the barrel assembly is in the action-open position.

26. The firearm of claim 25 wherein the breech plug further comprises:

a shaft portion having a forward plug end and a rear end, said actuator knob being attached to the rear end of the shaft portion, and said interrupted threads being formed in the shaft between the forward plug end and the actuator knob, and said forward plug end mating with the barrel bore to enclose the chamber when the breech plug is locked in place in the barrel bore; and at least one O-ring seal disposed about the shaft for creating a seal between the breech plug and barrel when the breech plug is locked in place in the barrel bore.

* * * * *

UNITED STATES PATENT AND TRADEMARK OFFICE

CERTIFICATE OF CORRECTION

PATENT NO. : 7,908,781 B2
APPLICATION NO. : 11/971933
DATED : March 22, 2011
INVENTOR(S) : Mark C. Laney et al.

It is certified that error appears in the above-identified patent and that said Letters Patent is hereby corrected as shown below:

Column 11, line 47 (Claim 8, line 1) please delete "6" and insert --10--.

Signed and Sealed this
Twenty-eighth Day of June, 2011

David J. Kappos

David J. Kappos
*Director of the United States Patent and Trademark Office*